United States Patent [19]

Asher et al.

[11] Patent Number: 4,703,521

[45] Date of Patent: Nov. 3, 1987

[54] MULTI-PURPOSE GARMENT

[75] Inventors: Ron E. Asher, Virginia Beach; Charles J. Lesko, Hampton, both of Va.

[73] Assignee: Ecotat System Company, Virginia Beach, Va.

[21] Appl. No.: 877,345

[22] Filed: Jun. 23, 1986

[51] Int. Cl.[4] ..... A41D 3/08; E04H 15/30

[52] U.S. Cl. ..... 2/69; 2/89; 2/69.5; 135/95

[58] Field of Search ..... 2/69, 69.5, 89, 93, 2/94; 135/95, 104, 106

[56] References Cited

U.S. PATENT DOCUMENTS

| | | | |
|---|---|---|---|
| 703,245 | 6/1902 | Faulkner | 2/89 |
| 1,895,911 | 1/1933 | Bosson, Jr. | 2/89 |
| 3,584,315 | 6/1971 | Hardy | 2/89 |
| 4,484,362 | 11/1984 | Asher | 2/69 |
| 4,579,753 | 4/1986 | Gjendemsjo | 2/69.5 X |
| 4,594,735 | 6/1986 | Rolf et al. | 2/89 |
| 4,605,029 | 8/1986 | Russell | 2/69.5 X |

*Primary Examiner*—Ronald Feldbaum
*Assistant Examiner*—J. L. Olds
*Attorney, Agent, or Firm*—William F. Frank

[57] ABSTRACT

A multi-purpose garment comprising a central portion and first and second end portions, the portions being rhombic in shape. The first end portion tapers inwardly from the central portion, and the second end portion tapers outwardly from the central portion. A pair of tent pole sleeves and a pair of ventilation openings are provided at the juncture of the first end portion and the central portion. A pair of tent pole sleeves are provided at the juncture of the second end portion and the central portion. On the underside ofthe garment, a sleeve extends along the outer end of each end portion, each sleeve containing an elastomeric cord to selectively compress selected portions of the garment.

9 Claims, 16 Drawing Figures

MULTI-PURPOSE GARMENT

FIELD OF INVENTION

The present invention is in the field of a garment which can be used by outdoors persons as well as military personnel. More particularly it is a garment which provides protection against weather as a short coat, long coat or tent.

BACKGROUND OF THE INVENTION

In the past, outdoors persons who hiked, climbed, fished or hunted as well as military personnel required protective coverings which would keep them dry and relatively warm under conditions wherein their activities would require weather protection of the upper body or, in the event of rain, maximum body protection in addition to providing a sleeping shelter. In the past, such protection required carrying a poncho-like garment which unfortunately had great bulk and was not easily worn over a backpack. To provide a sleeping shelter required the carrying of an additional piece of equipment which basically had to be joined to like a piece of equipment. Even this arrangement will not provide necessary protection because of the open ends of the so constructed shelter. Neither the poncho-like garment nor the shelter half could provide subsidiary uses such as a hammock or a single shelter. Neither article could provide a sleeping bag.

These disadvantages were overcome by the U.S. Pat. No. 4,484,362. For the first time there became available a single article which could be arranged in different modes to provide an anorak (short coat) covering the upper body and a backpack; a cagoule (long coat) protecting the legs in addition to the body while wearing a backpack; and an enclosed tent for a single occupant but being capable of being joined to a like article to provide a closed shelter for two persons; a summer shelter for a single person with a netted opening; a closed protection for seated person as well as a hammock. As great an improvement as the article disclosed in U.S. Pat. No. 4,484,362 was, continued trials disclosed short comings while detracted from is universality. The sleeping accommodation modes required the presence of suitable vertical structure such as trees for the suspension of the end portions of the article. Additionally the multipurpose article of U.S. Pat. No. 4,484,362 was basically a rectangular sheet. Extensive experimental field trials disclosed that there was excessive material in both end portions which served no true purpose in the sleeping shelter and hammock uses. Furthermore, the ratio of width to length was restriction in the sleeping shelter mode as to provide a cocoon like environment which was uncomfortable to user. Also the width of the multipurpose garment of U.S. Pat. No. 4,484,362 was found to be somewhat restrictive in walking as well as in rainy weather directing the flow of water onto the legs and feet of the wearer.

SUMMARY

In the present improvement over the multipurpose garment disclosed in U.S. Pat. No. 4,484,362, the top and bottom portions of the garment have been taper reduced, the garment has been enlarged in width and length, sleeves have been provided to give the garment in the sleeping shelter mode an independently suspended form which has a water-tight integrity of approximately 3 inches above the surface upon which the sleeping mode has been erected.

BRIEF DESCRIPTION OF THE INVENTION

The present invention can be seen in the accompanying illustrator of the preferred FIG. 1 is an top plan view of the present invention.

DETAILED DESCRIPTION OF THE INVENTION

Figure 1:
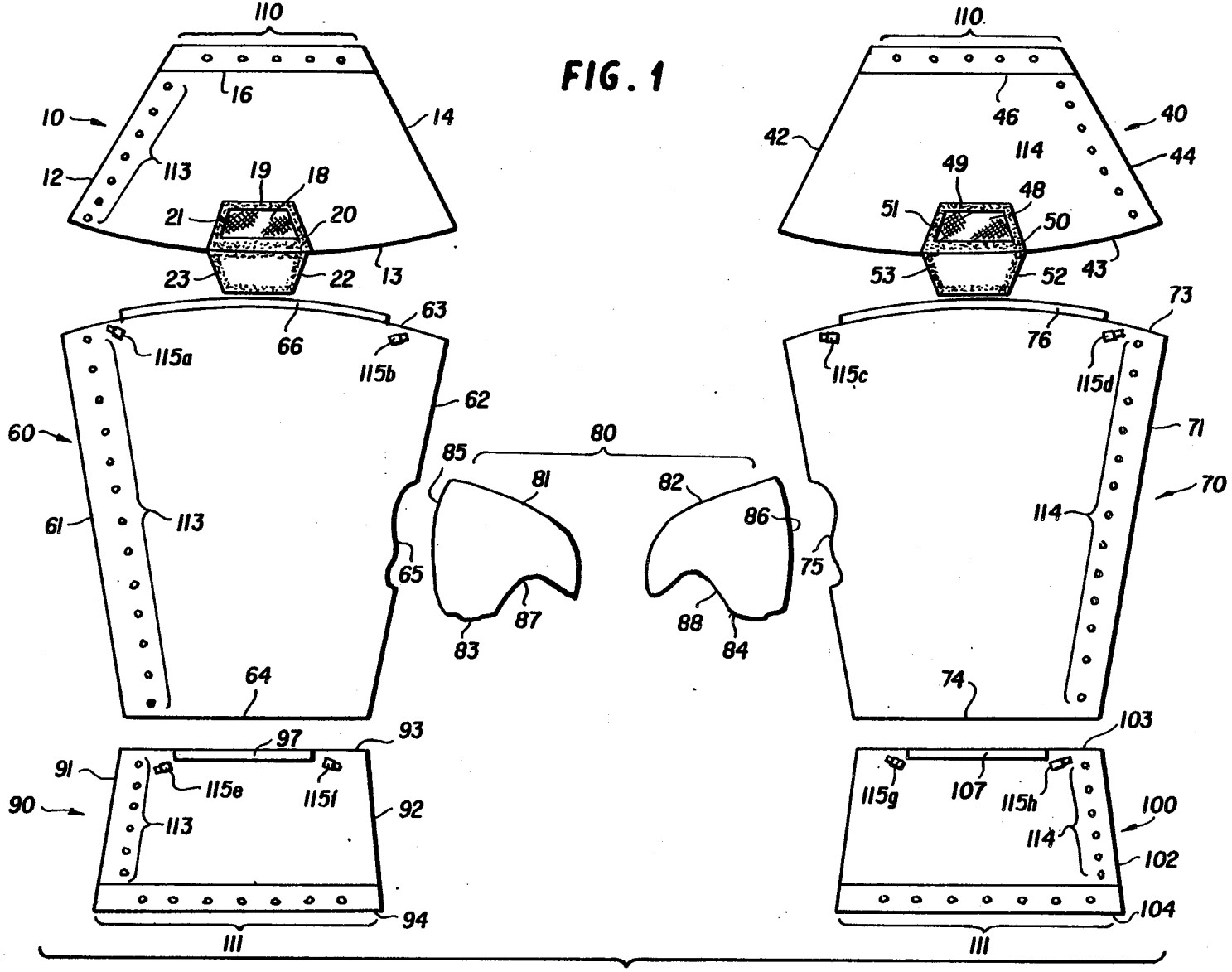

With general reference to the drawing figures, the present invention uses a material from the many available which has the characteristics ranging from water-impermeable/air-permeable to water and air impermeable. Within this range, there are many fabrics. An additional characteristic of a desirable material is that the material does not become rigid or stiff at sub-zero temperatures. This is particularly important in military application since a stiff material is creates unwanted noise as the wearer moves through underbrush and the like. Preferably the material will be moisture impermeable and soft. Polyeurathane coated synthetic fabrics are preferable.

Returning to the drawings, FIG. 1 shows the major components of the present invention before assembly. This exploded view was selected to display the shapes of the components of the invention which results in a multipurpose garment which has less unneeded and unused material and more correctly provides the variety of applications to the need of the user than the previously cited patent and application of the assignee.

Specifically, with reference FIG. 1, the present invention comprises a left body portion 60, a right body portion 70, lower left back body portion 10, a lower right back body portion 40, a lower left front body portion 90, a lower right front body portion 100 and a hood portion 80.

Since the components of the matching portions are identical in the interest of brevity, the principal portions are described with reference to one portion with identical opposite elements being identified by appropriate opposite reference numeral. The body portions 60 and 70 are generalized rhombic in shape, having lower front edges 64 and 74 from which extend outwardly extending edges 61, 62, 71 and 72. The terminus of edges 61, 62, 71, and 72 which are opposite edges 44 and 74 are edges 63 and 73 which are arcurate in contrast to straight edges 64 and 74. The arcurate edges 63 and 73 drape the present invention more closely over a backpack when the invention is used as a coat and provide a more compatible curvature of the garment when used as a tent. Tent pole sleeves 66 and 76 are provided to receive the tent poles provided with the present invention. Body portion 60 and 70 are provided with matching cut out edges 65 and 75 which when edges 62 and 72 are sewn together provide an opening into which the hood portion 80 is inserted after edges 83, 84, 85, 86, 89 and 90 are sewn together to provide a head opening circumscribed by edges 87 and 88.

Figure 3:
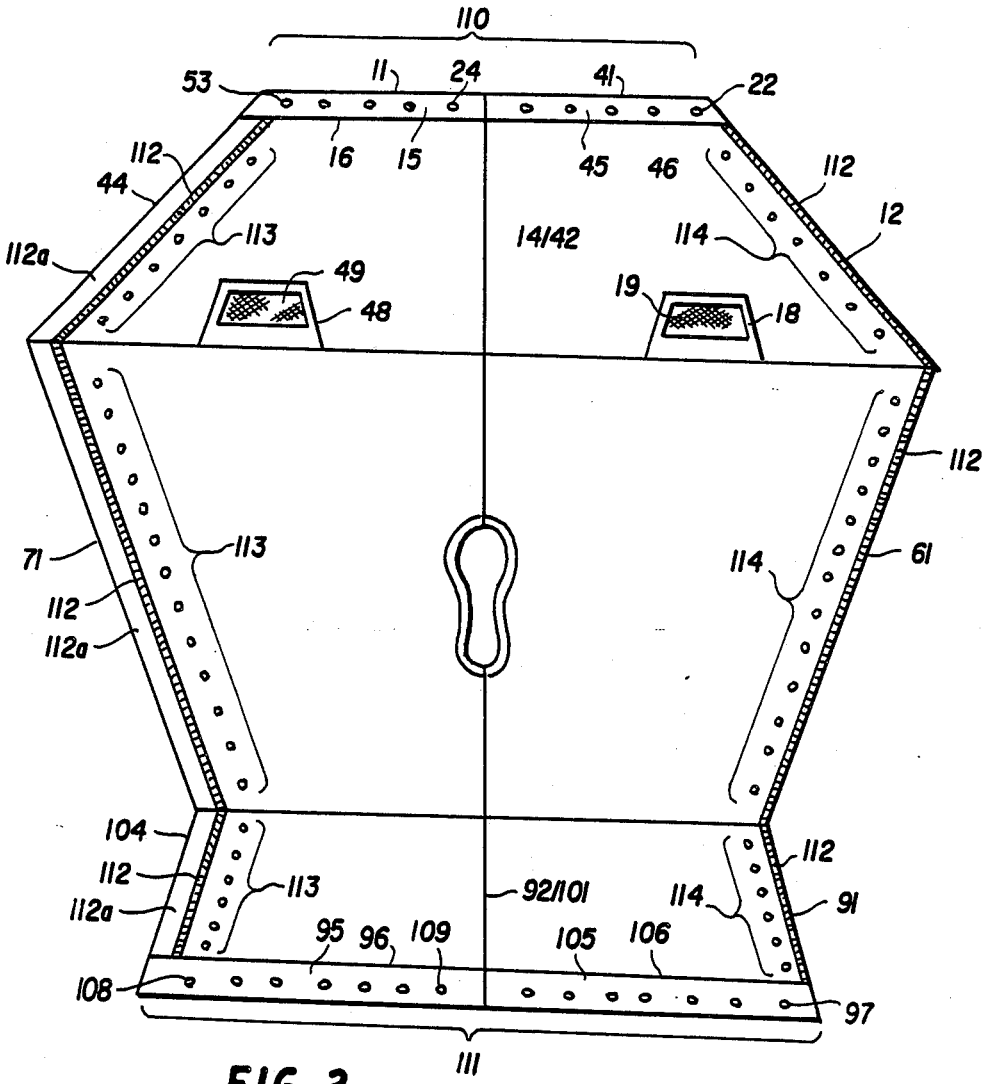
FIG. 3 is a schematic bottom side view of the present invention.

Lower back portions 10 and 40 are rhombic in shape, edges 13 and 43 have an arcurate form having the same but opposing radius of curvature as edges 63 and 73 of body portions 60 and 70 to which they are joined by sewing and sealing. Portions 10 and 40 are provided with rhombic openings 18 and 48 adjacent edges 13 and 43 which provide ventilation when the present invention is in the tent mode. Openings 18 and 48 are covered by fiberglass mesh material 19 and 49. The mesh material 19 and 49 is held in place by rhombic frames 20 and 50 of the basic material which are sewn in place and sealed. Nylon loop strips 21 and 51 are sewn and sealed to encompass openings 18 and 48. Flaps 22 and 52 to close openings 18 and 48 respectively have circumferentually mounted nylon locking material 23 and 53 and are joined to portions 10 and 40 when edges 13 and 43, 63 and 73 and pole sleeves 66 and 76 are sewn together and sealed. End portions of edges 11 and 41 carry sleeves 15 and 45 as seen in FIG. 3 each of which contains an elastomeric 121 cord in FIG. 14, each end of each cord having an end tip 122 having a V-shaped slot 123 to catch and hold the a portion of the cord when the cord is used in the application of the invention. The sleeves 15 and 45 are formed by sealingly sewing a separate sleeve portion to the underside of respective back portions 10 and 40 along edges 11 and 41 and seaming them along interior spaced seams 16 and 46 and sealing these seams as seen in FIGS. 1 and 3.

Lower front portions 90 and 100 are rhombic in shape with parallel edges 93 and 94 and 103 and 104. Sleeves 95/105 seen in FIG. 3 are formed in the same manner as sleeves 15/45 with sealed interior seams 96 and 106, the joined sleeve containing an elastomeric cord 121 with end tip 122 as in FIG. 14. Portions 90 and 100 carry tent pole sleeves 97 and 107 which are held within the seams joining edges 93 and 103 which in turn are sealed. It is to be noted that edges 91, 92, 101 and 102 taper outwardly to edges 94 and 104. This outward taper results in edges 94 and 104 extending forwardly and outwardly of the body of the wearer when the present garment is worn in the great coat configuration in FIG. 11, particularly during rain thus directing the rain away from the lower legs and shoes of the wearer. The outward taper also provides increased stability when the present invention is used as a tent.

Figure 2:
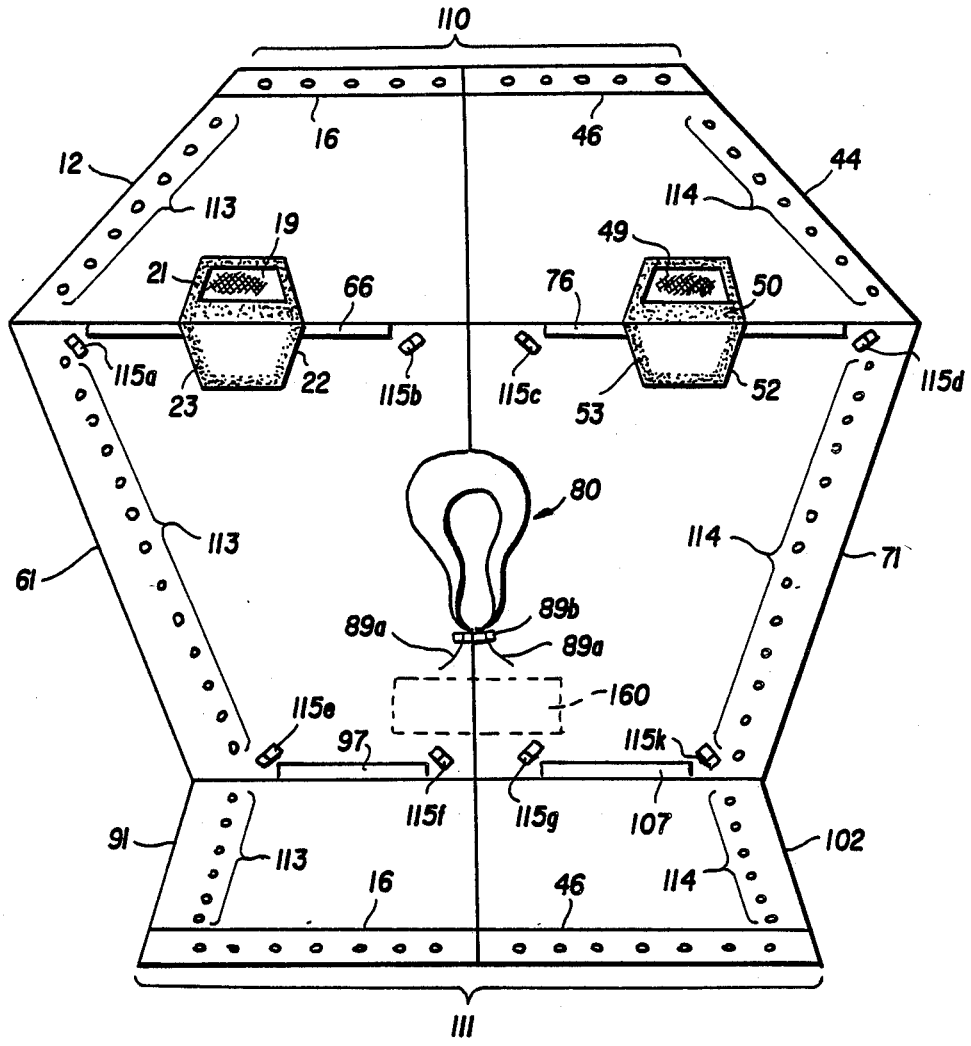
FIG. 2 is a schematic topside plan view of the present invention.

Referring now to FIGS. 2 and 3, it is to be understood that the arcurate form of edges 13, 63, 43 and 73 when sewn together and sealed do not permit clear planular view of the assembled portions of the present invention in as much as the arcurate edges when sewn together create a bunching up of the garment along those seams which cannot be clearly and understandably illustrated by drawings. Therefore it was decided to present the assembled portions of the garment as shown in these figures for simplicity and clarity in viewing the assembled garment.

Figure 5:
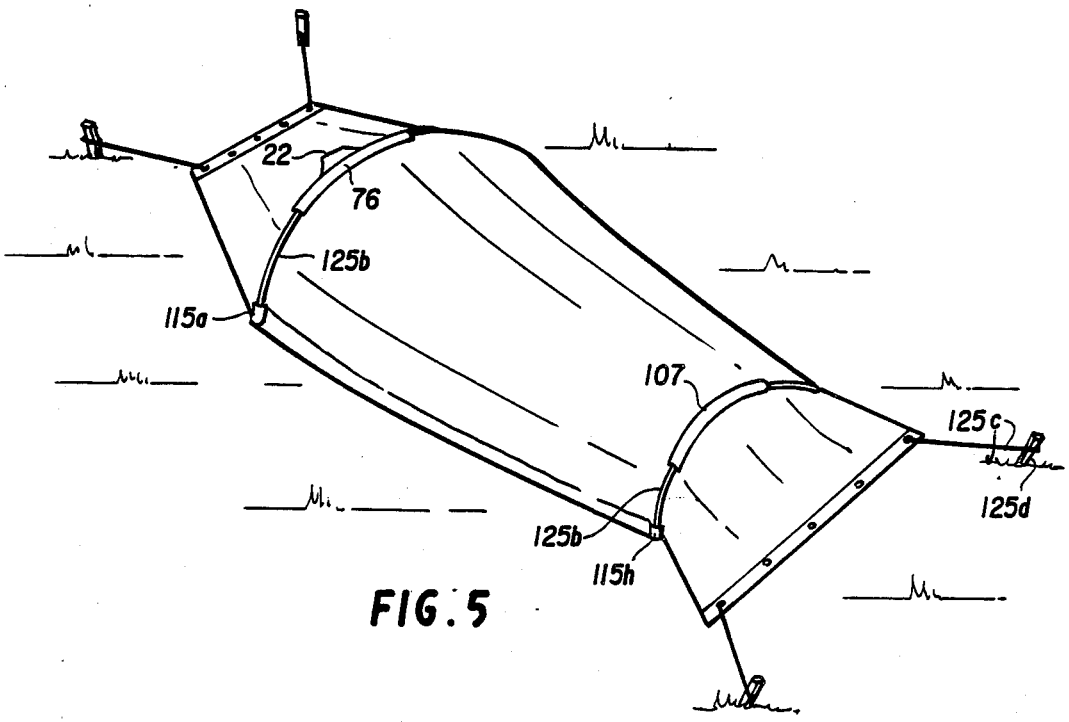
FIG. 5 is a view of the present invention in the embodiment of a single occupant inclement weather shelter.
Figure 6:
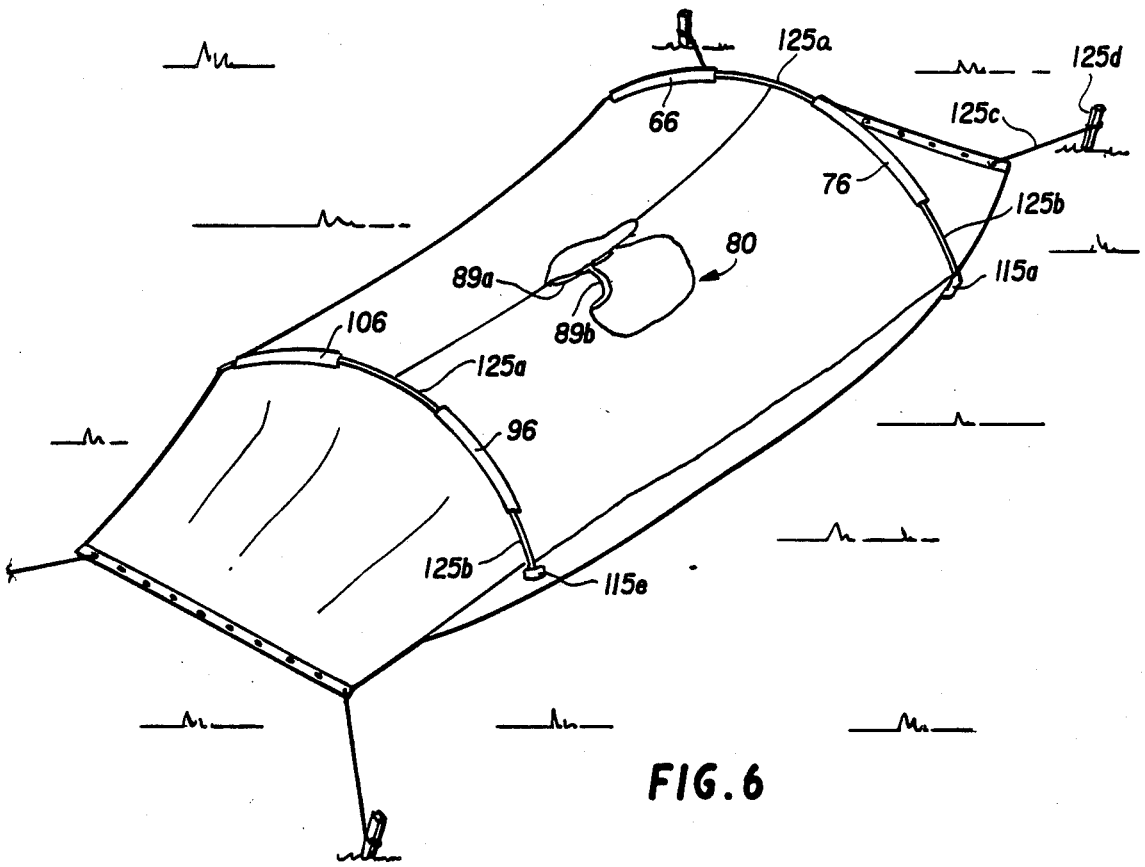
FIG. 6 is a perspective view of the present invention as a two occupant inclement weather shelter.
Figure 15:
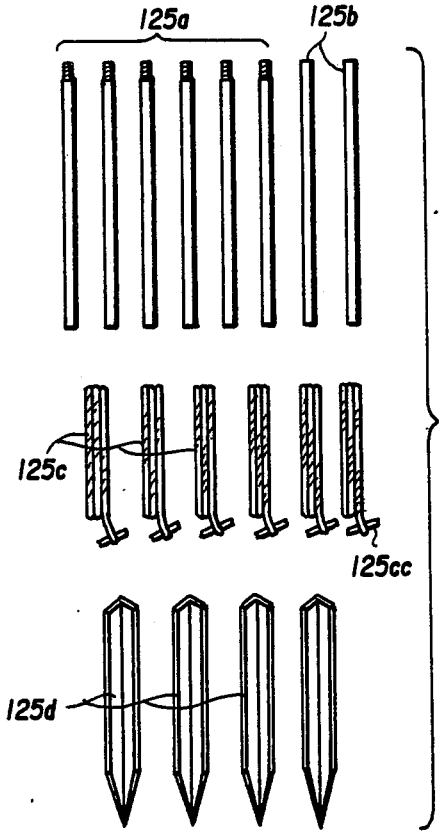
FIG. 15 is a perspective view of the tent poles, stokes and grey lines included as a part of the invention.
Figure 13:
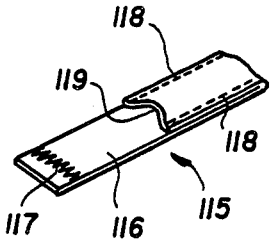
FIG. 13 is an enlarged view of the tent pole webbing pockets.

As seen in FIGS. 1–3, end portions 11/41 and 94/104 carry a plurality of snaps 110 and 111 respectively. Edge portions 12, 61, 91, 102, 71 and 44 similarly carry a line of snaps 113 and 114 respectively. It will be noted that snaps 113 and 114 are spaced interiorly from their respective edges. As seen in FIG. 3, a continuous line of double acting zippers 112 is sealingly sewn along edges 12, 61, and 91 and spacedly and sealingly sewn adjacent to edges 44, 71 and 104 on the interior side of the present garment. The positioning of zipper 112 spaced from edges 44, 71 and 104 provides an over hanging flap to protect the joined zippers in a tent mode from rain. In accordance with the present invention the tent poles seen disassembled in FIG. 15 are inserted into the pole sleeves 66, 76, 77 and 107 as will be subsequently described. To achieve the desired arcurate form of the tents as seen in FIGS. 5 and 6 the ends of the assembled tent poles are inserted in respective tent pole pockets 115 while are attached to portions 60, 70, 90 and 100 adjacent the respectives ends of the respective tent pole sleeves 66, 76, 97 and 107. The tent pole pockets 115 comprises at least one layer of a web strap 116 secured at one end to its respective garment body portion by sealed stitching 117 as shown in FIG. 13. The other end of the strap 116 is folded over as shown and stitched at 118 to form a pocket 119 to receive the end of an assembled tent pole as will be described.

Figure 4:
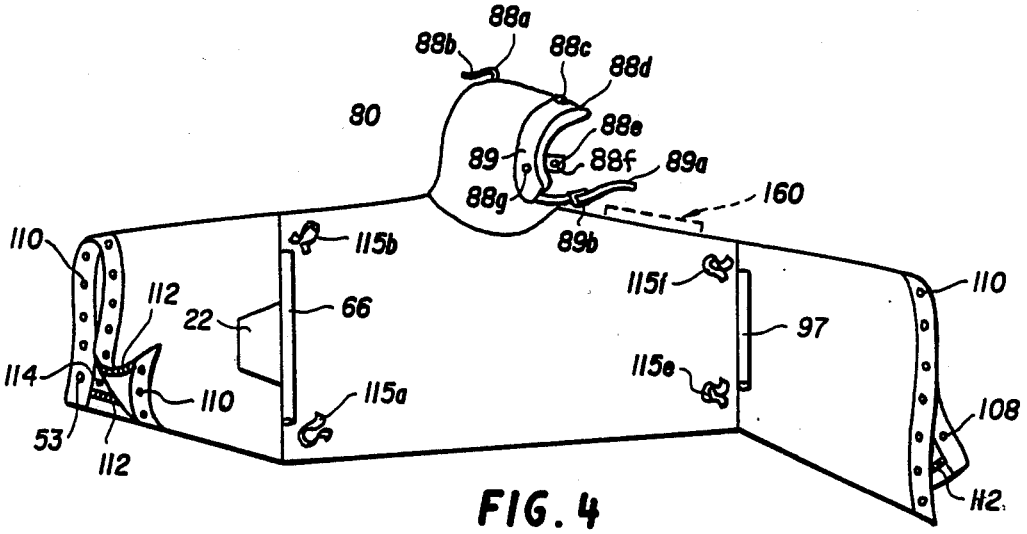
FIG. 4 is a pictorial view of the present invention.

As best seen in FIG. 4 hood 80 is provided with a tab **88*a* attached to the rear upper surface of the hood and having a nylon loop patch 886 which can be engaged with a nylon hook patch 88*c* on the visor 88*d* of the hood to hold the hood in an open position. Additionally one side of hood sleeve 89 is provided with a tab 88*e* having a nylon loop patch 88*f* which can engage a nylon loop patch 88*g*** to close hood about the face of the wearer to cover the nose and mouth of the wearer.

Again with reference to FIG. 2 when the garment portions 10, 40, 60, 70, 90 and 100 are sealingly sewn together, hood portion 80 is sewn and sealed along edges 85 and 86 and edges 81 and 83 are sewn and sealed into edges 65 and 75. Edges 88 and 87 are folded over to form a sleeve 89 (FIGS. 2 and 4) through which runs a hood cord **89*a* to selectively draw the hood around the head of the wearer or to close the hood opening completely in the tent configurations of FIGS. 5, 6 and 16. A slide 89*b* is provided to engage each end portion of cord 89** to restrain the hood opening in the desired position.

Figure 14:
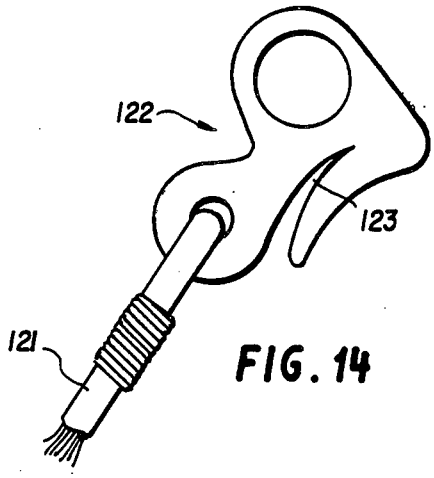
FIG. 14 is a perspective view of the V-notched terminal of the cords undecided as a part of the present invention.

Referring to FIG. 3 and 14 it will seen that joined sleeves 15/45 and sleeves 95/105 terminate in an angled edged matching edges 12, 44, 91 and 102. Sleeves 15/45 and 95/105 are open at each end which provides access to the elastomeric cord 121 which extends through each sleeve and terminates in a flat plastic cord holder 122, each holder having a notch 123 therein which receives and holds portions of the respective cord when it is elongated. The device disclosed in U.S. Pat. No. 3,953,911 is preferred.

Referring back to FIG. 3 it will be seen that the extreme ends of sleeves 15/45 are provided with grommets 22 and 53 and the extreme ends of sleeves 95/105 are provided with grommets 97 and 108. The purpose and use of these grommets will be described with reference to FIGS. 5–9. Each sleeve is also provided with a grommet 24 and 109 adjacent seam 14/142 and seam 92/101 respectively.

Figure 7:
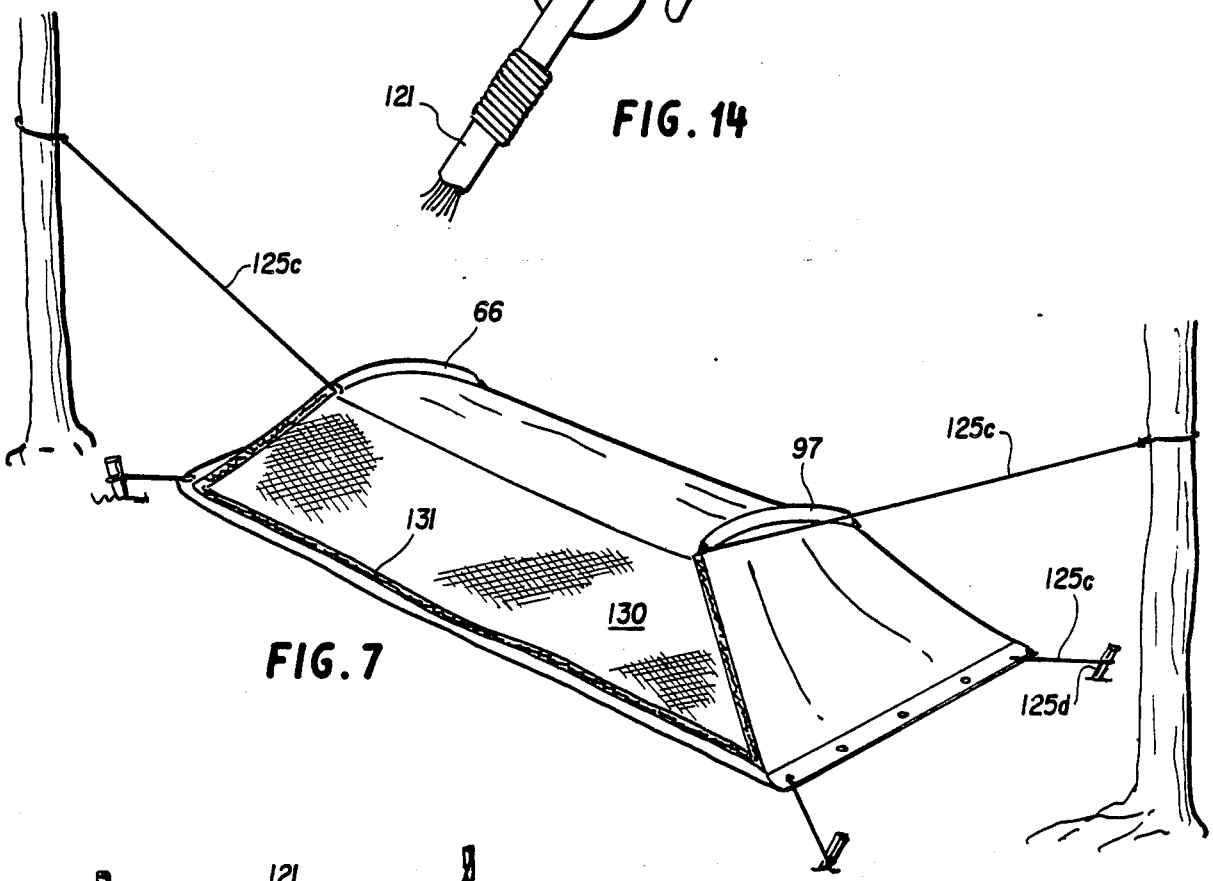
FIG. 7 is a perspective view of the present invention as a fair weather shelter.
Figure 9:
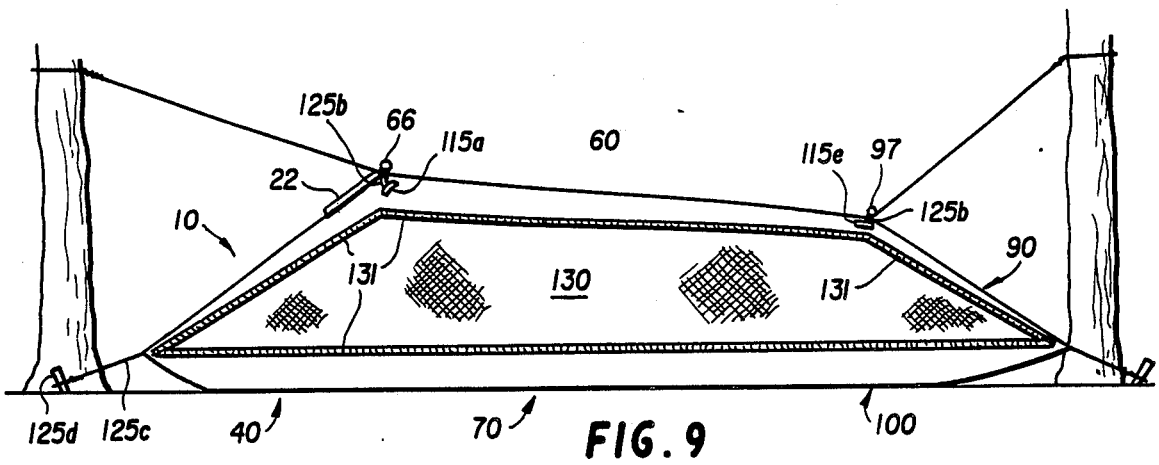
FIG. 9 is an elevation view of the present invention as seen FIG. 8.

The accessories for the present invention can be seen in FIGS. 7, 9 and 15. FIGS. 7 and 9 show the bug-proof netting 130 which is used in the fair weather shelter seen in those figures. As can be seen the netting is rhombic in shape and carries a doubleacting zipper 131 around its periphery. Zipper 131 mates with zipper 112 shown in FIG. 3. FIG. 15 shows the accessories used to form the inclement weather shelters seen in FIGS. 5, 6, and 16. They comprise 6 pole sections having threaded male portions on one end with mating female portions on the opposite end and 2 pole sections having only mating female portions on one end; 6 tent greylines of flexible woven, weather resistant thermoplastic material; and 4 tents stakes as shown, preferrably of rust resistant material and capable of being pounded into the ground.

The single occupancy shelter seen in FIG. 5 is formed as follows. Layout the garment with the inner side (FIG. 3) up. Fold edges 41, 71 and 164 over to edges 12, 61 and 91 and close the respective zippers. Snap edges 11/41 to edges 94/104 together. Pull end of hood cord 89 to completely close hood about opening 66/95 and securely tie the hood. Make up two tent poles each of 4 sections **125*a* and 125*b*. Beginning on the zippered side insert one pole through sleeve 97 and insert the extending pole end into adjacent pole pocket 115. Then arching the pole insert the opposite pole end into the adjacent pole pocket 115. Repeat these steps with the other pole. Insert the end of one line 125 in grommet 24 and secure the end of the line. Insert the end of another line 125*c* in grommet 53 and secure the line end. Repeat the procedure with grommets 107 and 108. Insert two stakes 125*d* at an angle of about 30 degrees with reference to end 94/104 and secure the free ends of the lines attached to grommets 109 and 108**. Repeat this procedure at the opposite end making certain the shelter is taut and substantially wrinkle-free.

The two man shelter of FIG. 6 is formed by firstly closing off both hood openings as described for FIG. 5. One garment is placed on the ground with the outer or hood side down. The other garment is placed over the first with the hood side up. The zippers of both garments and the end snaps are joined together. Two tent poles are assembled from the ferrule sections **125*a* and one unferruled section 125*b*. One pole is inserted into sleeve 97/107. After passing through the sleeves one end of the pole is inserted into adjacent pole pocket 115 and the other end is then inserted into pole pocket 115 thus arching the pole. The same procedure is followed with the other tent pole and the garment is extended to its fullest length. One guy line 125*c* with its attached cabiclic 125*e* is inserted into grommet 22, another into grommet 53 and yet another into grommet 24. At the other end, a guy line 125*c* with associated cabiclic is inserted into grommet 97, another into grommet 108 and a third into grommet 109. The guy line attached to grommets 22, 53, 97 and 108 are then drawn out at angles of about 30 degrees from the respective ends of the so assembled garments and secured to stakes 125*a*. Guy lines attached to grommets 24 and 109 are drawn out perpendicular to the ends of the assembled garments and secured to stakes 125*d***.

The fair weather shelter of FIG. 7 is formed by again closing off the hood as described with reference to FIG. 5. Netting 130 is provided around its periphery with a double acting zipper 131 which is compatible with zipper 112. End portions 10 and 40 are snapped together with snaps 110 and 111. Two poles are formed with 3 ferruled sections **125*a* and one unferruled section 125*b*. One pole is inserted into the end of pole sleeve 107 nearest the zippered netting and garment juncture. The end of the pole exiting sleeve 107 is inserted into pole pocket 115. The other end of the pole is inserted into pole pocket 115. The same procedure is followed with reference to sleeve 76. One guy line 125*c* with its cabiclic 125*e* is inserted into grommet 22 and drawn out to be secured to a stake 125*d*. Another guy line 125*c* with its associated cabiclic 125*e* is inserted into grommet 97 and is attached to a vertical support as available. Additional guylines 125*c* are similarly secured to grommets 22 and 108 and secured as described with reference to grommets 53 and 108. Additional guy lines 125*c* with associated cabiclics 125*e* are inserted into grommets 24 and 109 are attached to a stake 125** and to a vertical support.

Figure 10:
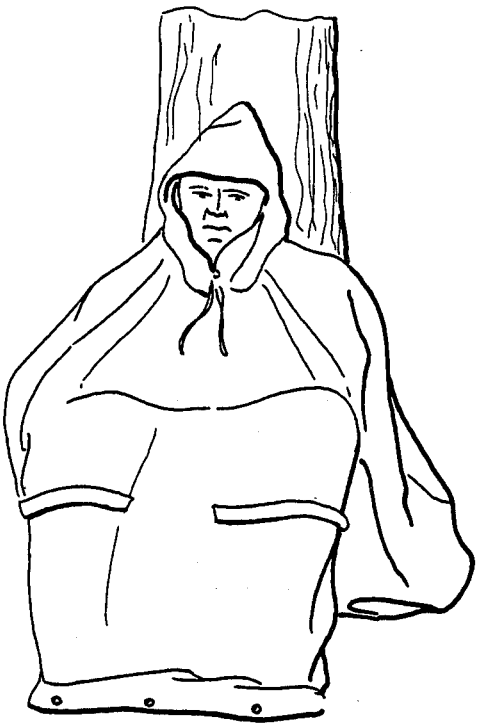
FIG. 10 is a pictorial view of the present invention when used as a sitting shelter.

The sitting shelter shown in FIG. 10 is formed by zipping sides 41, 71, 104, 12, 61 and 91 together approximately half way. Holding the thus zippered edges in front, step into the garment, lift up the unzippered portions up to insert the head into the hood opening. Throw the remaining portion of the garment over the head to the back, snap edges 11, 41, 94 and 104 together, turn the garment so the zippered portions are in the back and raise the hood over the head, leaving the unzippered together portions free.

Figure 11:
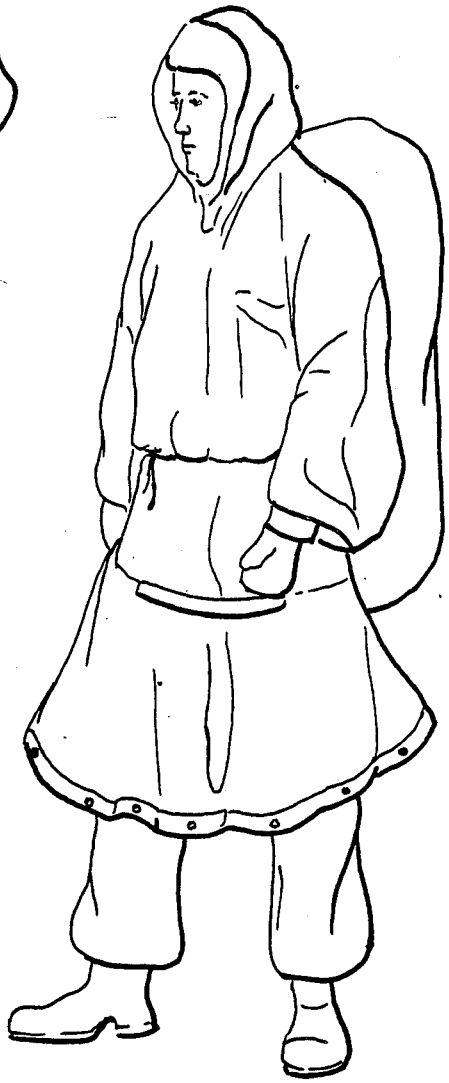
FIG. 11 is a pictorial view of the present invention when used to form a long outer coat with backpack protection.

To form the long coat seen in FIG. 11, begin with the garment as formed in FIG. 10 but with the edges 11, 41, 94 and 104 unsnapped. The unzipped portions are raised to form sleeves with ends 11/41 hanging free. Cord 121 is drawn from one end of sleeve 15/41 and passed around the back of the wearer to approximately waist level. The other end of cord 121 is held and the cord 121 is elongated to encompass the waist and one end is inserted in groove 123 thus forming a belt. The garment is smoothed over the front by pressing the excess material around each side of the wearer to the rear to provide the excess needed to cover any pack worn on the back of the wearer.

Figure 12:
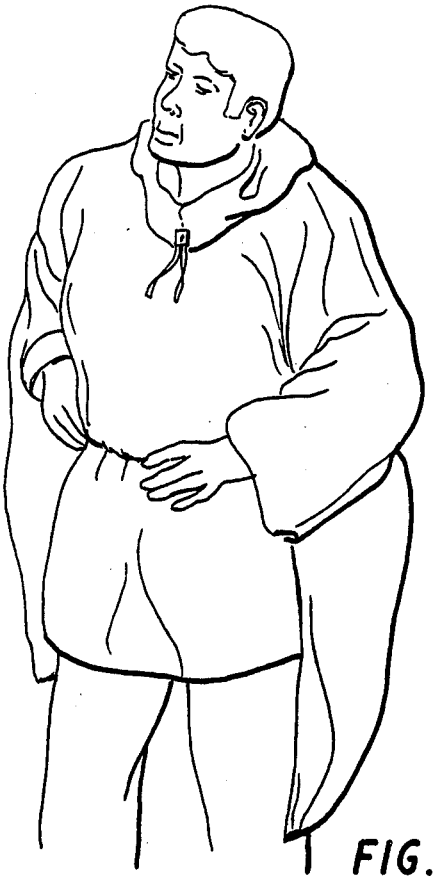
FIG. 12 is a pictorial view of the present invention when used to form a short outer coat with backpack protection.

To form the short coat seen in FIG. 12, the front edges 94 and 104 of the long coat are raised to approximately waist level. Cord 121 is then pulled from both ends of sleeve 95/105 and brought around the waist and inserted in one of grooves 123 as was done in forming the long coat.

Figure 16:
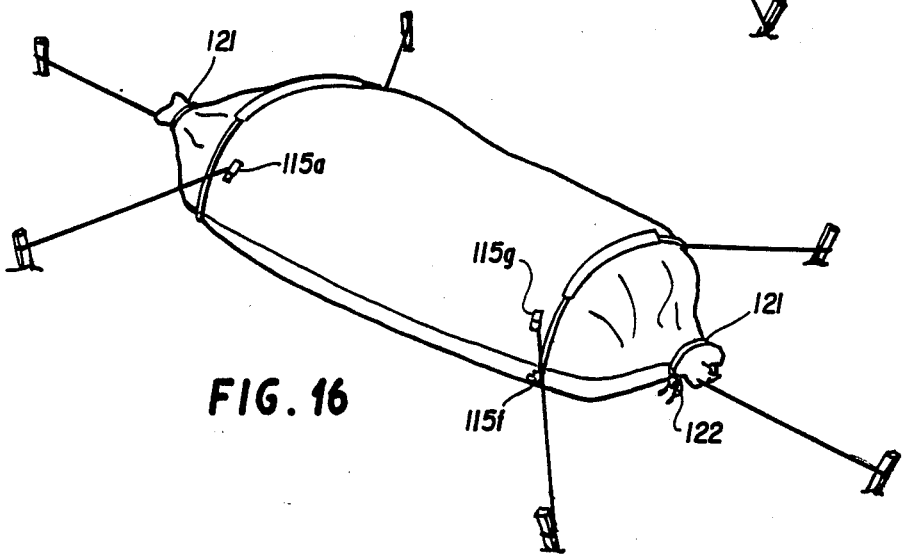
FIG. 16 is a perspective view of a modification of the sheltering FIG. 5.
Figure 8:
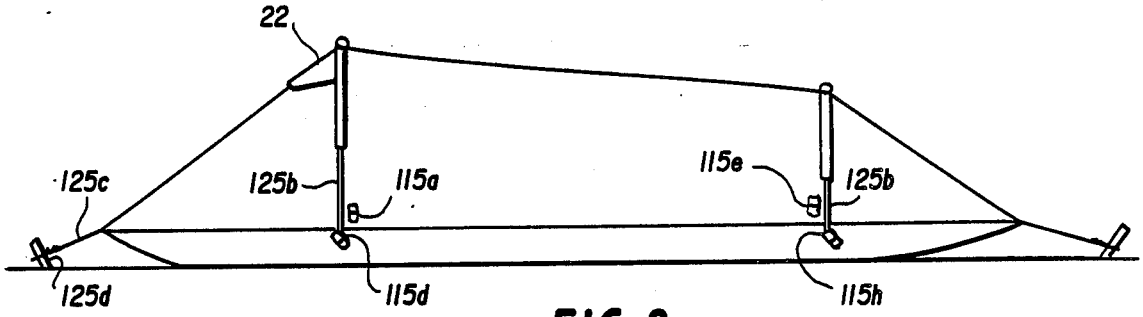
FIG. 8 is an elevation view of the present invention as seen in FIGS. 5 and 6.

The one man shelter seen in FIG. 16 is formed as described with reference to FIG. 5 and FIG. 8 with the exception that ends 11/41 and ends 94/104 are not guyed out to stakes **125*d*. Instead ends 11/41 and 94/104 are each gathered together as shown and cord 121 in the respective sleeves is used to secure the gathered ends as shown. The guy lines are attached to respective pole pockets 115 in lieu of the aforedescribed grommets. The guy lines are secured to stakes 125*d* as shown. The purpose of this modification of FIG. 5 is for use in desert areas to present entry of snakes, scorpions and the like through otherwise snapped together edges 11/41** and 94/104 because of the cool or cold night temperatures. An additional guy line 125*c* is secured to each gathered end and secured to a stake 125*d* to elongate the end portions as much as possible.

A bag is provided to carry the tent accessories. Alternatively, a pocket shown in phantom 160 in FIG. 2 may be provided.

What is claimed is:

1. An improved multi-purpose outer garment/comprising a central portion, first and second end portions joined to respective opposing edges of said central portion, adjustable hood means centrally positioned on an outer side of said central portion, ventilation means centrally positioned in said first end portion at the joining of said central portion and said first end portion, tent pole sleeve means positioned in the joining of said central portion and said first end portion and in the joining of said central portion and said second end portion, first snap means positioned adjacent outer ends of said first and second end portions respectively, zipper means on underside of said joined central and first and second end portions extending along both outer edges of joined portions substantially from of said first end portion to of said second portion, second snap means interior of said zipper means and parallel thereto and a sleeve formed along the outer end of each end portion on underside of said end portions, each sleeve containing elastomeric means to selectively compress selected portions of said garment means.

2. The garment means according to claim 1 wherein said central and first and second end portions are rhombic in shape.

3. The garment means according to claim 2 wherein said central portion comprises two substantially identical/rhombic sections, one end of each section being a straight line and opposing end of each section having an arcuate form, side edges of each section tapering outwardly from ends of each straight line end to ends of said arcuately formed ends of each section, the two sections being sealingly joined along two facing and opposing edges to form said central portion, each of said sections further having a tent pole sleeve centrally positioned along the arcuate end.

4. The garment means according to claim 2 wherein said first end portion comprises two substantially identical opposing rhombic sections, the outer ends of each section of said end portion being a straight line and the opposing end of each section having an arcuate form substantially identical to arcuate end of the adjacent central portion, side edges of each section tapering outwardly from the ends of each straight line end to the ends of said arcuately formed ends of each section, the two sections being sealingly joined along the two facing and opposing edges to form said first end portion, each of said sections further having ventilation means centrally positioned along the arcuate end.

5. The garment means according to claim 2 wherein said second end portion comprises two substantially identical opposing rhombic sections, outer ends of each section of said end portion being a straight line and opposing end of each section being a straight line, side edges of each section tapering inwardly from ends of said outer end to ends of the opposing end, the two sections being sealingly joined along the two facing and opposing edges to form said second end portion, each of said sections further having a tent pole sleeve centrally positioned along the straight line opposing end.

6. The garment means according to claim 1 wherein said central portion has a centralized opening therein to receive said hood means which is sealing secured around said opening, said hood means having a facial opening therein with a sleeve encompassing said opening and a draw cord within said sleeve and interlocking means on said hood to position said hood in selected positions relative to a wearer's head.

7. The garment means according to claim 1 further comprising a grommet at outer end of said sleeve and a grommet substantially centered in said sleeve.

8. The garment means according to claim 1 further comprising a plurality of tent pole end receiving pockets, pocket being positioned just beyond each end of each tent pole sleeve.

9. The garment means according to claim 1 having accessories which comprise a plurality of tent pole sections, a plurality of tent guy lines and a plurality of tent stakes.

* * * * *